US009617825B2

(12) United States Patent
Pray et al.

(10) Patent No.: US 9,617,825 B2
(45) Date of Patent: Apr. 11, 2017

(54) PACKER OR BRIDGE PLUG BACKUP RELEASE SYSTEM OF FORCING A LOWER SLIP CONE FROM A SLIP ASSEMBLY

(71) Applicant: BAKER HUGHES INCORPORATED, Houston, TX (US)

(72) Inventors: Jeffery S. Pray, Shenandoah, TX (US); Antonio C. Ruffo, Cypress, TX (US); David S. Bishop, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 44 days.

(21) Appl. No.: 14/566,024

(22) Filed: Dec. 10, 2014

(65) Prior Publication Data

US 2016/0168935 A1 Jun. 16, 2016

(51) Int. Cl.

| | |
|---|---|
| ***E21B 29/00*** | (2006.01) |
| ***E21B 19/00*** | (2006.01) |
| ***E21B 23/00*** | (2006.01) |
| ***E21B 33/129*** | (2006.01) |
| ***E21B 23/06*** | (2006.01) |

(52) U.S. Cl.
CPC ..... *E21B 33/1291* (2013.01); *E21B 23/06* (2013.01)

(58) Field of Classification Search
CPC ..... E21B 23/00; E21B 33/1291; E21B 23/06
USPC ..... 166/377
See application file for complete search history.

(56) References Cited

U.S. PATENT DOCUMENTS

| | | | | |
|---|---|---|---|---|
| 354,980 | A | 12/1886 | Hyde | |
| 4,813,486 | A | 3/1989 | Wyatt et al. | |
| 5,366,010 | A | 11/1994 | Zwart | |
| 6,349,770 | B1 | 2/2002 | Brooks et al. | |
| 7,604,055 | B2 | 10/2009 | Richard et al. | |
| 8,322,413 | B2 | 12/2012 | Bishop et al. | |
| 2010/0126725 | A1 * | 5/2010 | Ravensbergen | E21B 17/20 166/297 |

FOREIGN PATENT DOCUMENTS

WO 2011028812 A2 3/2011

* cited by examiner

*Primary Examiner* — Matthew R Buck
*Assistant Examiner* — Patrick Lambe
(74) *Attorney, Agent, or Firm* — Steve Rosenblatt

(57) ABSTRACT

A tool equalizes a packer or bridge plug before it can release the slips and sealing element of the packer or bridge plug with a reconfigurable grip tool. In one configuration the grip tool is latched only into the equalizing mechanism for the packer or bridge plug. Having equalized the pressure and while still latched to the equalization mechanism the tool is reconfigured with a force and locked into a second configuration. From that position the grip tool can latch and move the release mechanism for total release and retrieval to the surface. Release force undermines a ratchet lock for the slips to allow extension as the sealing element extends axially and radially retracts. If the slips fail to release with undermining of the ratchet lock then a set down force can be applied to re-engage the lower slip cone to push it from the lower slips for a release.

13 Claims, 20 Drawing Sheets

PACKER OR BRIDGE PLUG BACKUP RELEASE SYSTEM OF FORCING A LOWER SLIP CONE FROM A SLIP ASSEMBLY

FIELD OF THE INVENTION

The field of this invention is sequential equalization and then packer or bridge plug release with discrete mechanisms that are sequentially accessed with extension of the equalization and release tool and more particularly with a feature allowing forcible retraction of a lower slip cone from the lower slips should the slips fail to release with operation of the release mechanism.

BACKGROUND OF THE INVENTION

Packers and bridge plugs serve as wellbore isolation devices. The main difference is that bridge plugs have no passage through a mandrel and are an absolute barrier, while packers have a mandrel passage and are usually associated with a valve to control flow between zones that are isolated from each other when the packer is set. In either case, these devices when set will have some differential pressure across them and the standard procedure for safe operation is to equalize the pressure across the packer or bridge plug first before release of the slip and seal assembly of the packer or bridge plug.

Very old designs involved a single movement of a mechanism to accomplish both tasks. This movement was in a single direction where the initial movement first equalized and continued movement in the same direction then released the slips and seal elements of the packer or plug. One potential problem with such a design is if the slips and seal of the packer or plug are released before the equalization has fully finished there could be a large enough force left on the packer to send it moving in a direction toward the surface which could send the tubular string attached to such packer moving out of the hole and create a dangerous condition. Accordingly subsequent designs sought to make the equalizing step discrete from the release step by using two discrete mechanisms and a grip tool that is initially blocked from grabbing the release mechanism as it initially grabs the equalizing mechanism by a plurality of dogs that act as travel stops. After the grip tool engages the equalizing mechanism and picks it up to equalize, a recess is presented opposite the dogs acting as a travel stop so that on a subsequent jarring down movement after equalization, the release mechanism is gripped because the dogs acting as a travel stop have gone into the recess so that a subsequent jarring up motion then releases the slips and sealing element of the packer. This system is described in detail in Bishop U.S. Pat. No. 8,322,413. Some problems inherent to this design are that wellbore debris could deposit near the dogs or their associated recess so that the packer release mechanism could not be gripped by the grip tool making release of the packer difficult if not impossible and dictating a milling operation for removal of the packer. Another issue with the Bishop '413 design was that once the lock ring below the slips was released to allow the packer to extend in a downhole direction for retraction of the upper and lower slips and sealing element there was still an issue as attempts were made to bring up the packer of the slips either not releasing their grip on the surrounding tubular or the slip cone not extending far enough away from the slips or getting pushed back under the slips as the packer was moved uphole causing the packer to get stuck.

To address these issues a grip tool was designed that eliminates the need for the dogs that act as a travel stop by having a grip tool that is initially only capable of reaching the equalizing mechanism. After equalization a further force applied in the same direction as for the equalizing results in a reconfiguration of the grip tool and locking the grip tool in the reconfigured position. In the locked reconfigured position, the grip tool is capable of engaging with the packer or plug release mechanism with an applied force. After such latching the applied force direction is reversed and the tool is released with an undermining of the ratchet lock used initially to hold the set position. In the event of a failure to release just relying on the stored potential energy of the set packer element an option is provided to re-engage the lower ratchet lock and transfer a downhole force to the lower slip cone to push the lower slip cone downhole from under the slips so as to provide another opportunity to get the slips and packer seal to release. An emergency release is provided to be able to remove the grip tool if the equalizing and release mechanisms fail to operate so that the grip tool and associated wireline can be removed from the borehole before fishing is attempted.

These and other features will be more readily apparent to those skilled in the art from a review of the description of the preferred embodiment and the associated drawings while keeping in mind that the full scope of the inventions described herein are to be determined by the appended claims.

Retractable slips are illustrated in U.S. Pat. No. 4,813,486 while retrievable bridge plugs and associated running tools are discussed in U.S. Pat. No. 5,366,010. Also relevant to telescoping tools are U.S. Pat. No. 6,349,770; completion method with telescoping perforation and fracturing tool U.S. Pat. No. 7,604,055; Downhole telescoping tool with radially expandable members WO 2011028812 and method and apparatus for accommodating telescoping action U.S. Pat. No. 3,354,950.

SUMMARY OF THE INVENTION

A tool equalizes a packer or bridge plug before it can release the slips and sealing element of the packer or bridge plug with a reconfigurable grip tool. In one configuration the grip tool is latched only into the equalizing mechanism for the packer or bridge plug. Having equalized the pressure and while still latched to the equalization mechanism the tool is reconfigured with a force and locked into a second configuration. From that position the grip tool can latch and move the release mechanism for total release and retrieval to the surface. Release force undermines a ratchet lock for the slips to allow extension as the sealing element extends axially and radially retracts. If the slips fail to release with undermining of the ratchet lock then a set down force can be applied to re-engage the lower slip cone to push it from the lower slips for a release.

DETAILED DESCRIPTION OF THE PREFERRED EMBODIMENT

Figure 1A:
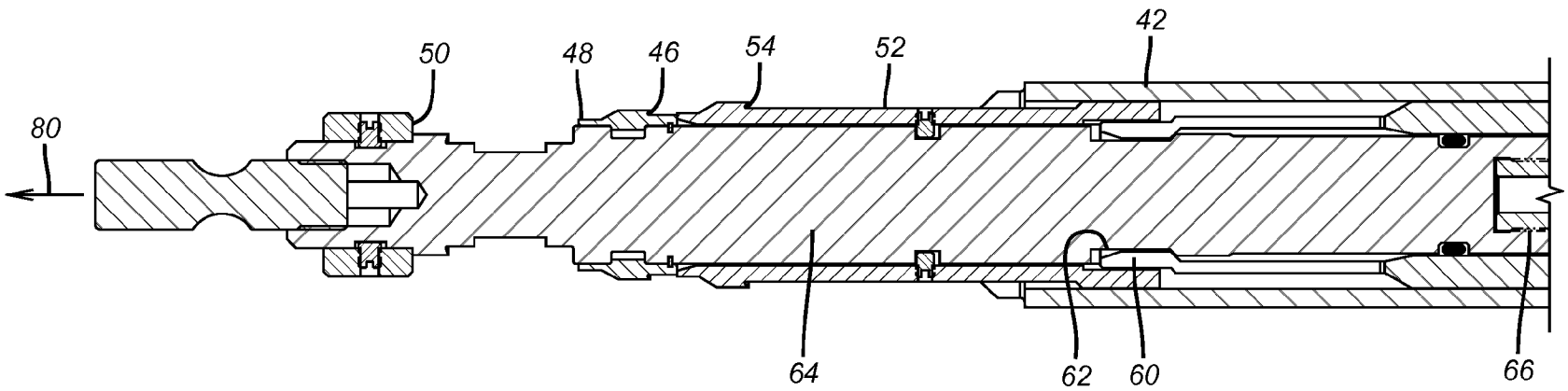
FIGS. 1*a*-1*d* show a bridge plug in the run in position in section.

FIGS. 1*a*-1*d* will be used to provide a quick review of the major bridge plug components with the understanding that the configuration is virtually the same for a packer except that the mandrel has a flowpath through it. The illustrated bridge plug 10 has a seal assembly 12 with an embedded upper band spring 14 and a lower embedded band spring 16. An upper cone 18 and lower cone 20 flank upper slips 22 and lower slips 24. An inner mandrel 26 has a through passage 28 that provides a flow path starting from ports 30, through passage 28, to openings 32 shown in FIG. 1*b*. Ports 34 are closed by sleeve 36 straddling o-rings 38 and 40. Sleeve 36 is connected to equalizer sleeve 42 at thread 44. Sleeve 42 has an exterior profile 46 which is initially retained by the grip tool shown in FIGS. 2-4. The grip tool can be lowered into the FIG. 2 position on wireline, slickline, coiled or rigid tubing. When used with wireline or slickline, the assembly further features a jar tool of a type known in the art for force application as needed in opposed directions as will be explained below. Equalizing the set plug 10 happens with movement of sleeve 36 away from overlapping at least o-ring 40. This happens when the top end 48 of sleeve 42 is picked up with the grip tool and raised against travel stop 50 as shown in FIG. 3*a*.

Figure 1B:
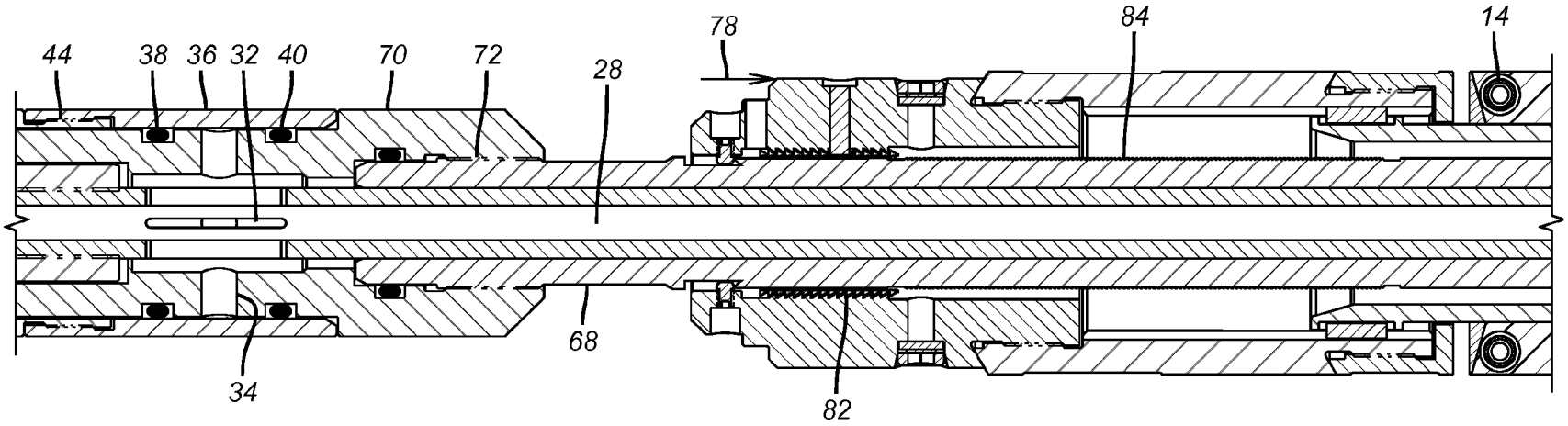
Figure 1C:
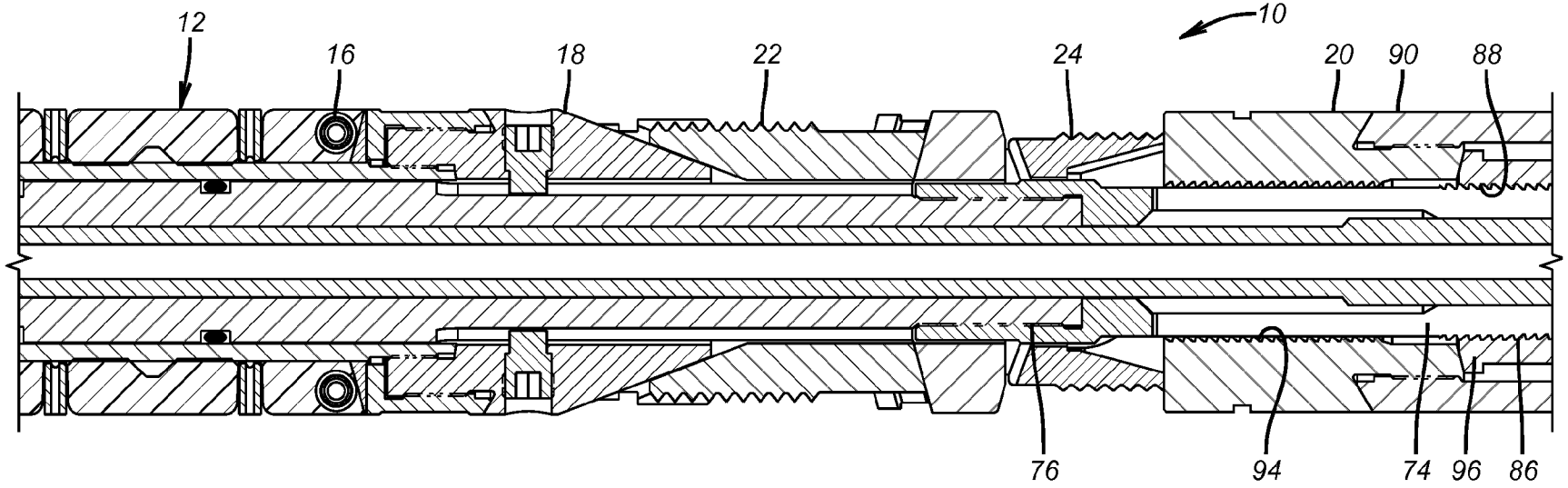
Figure 1D:
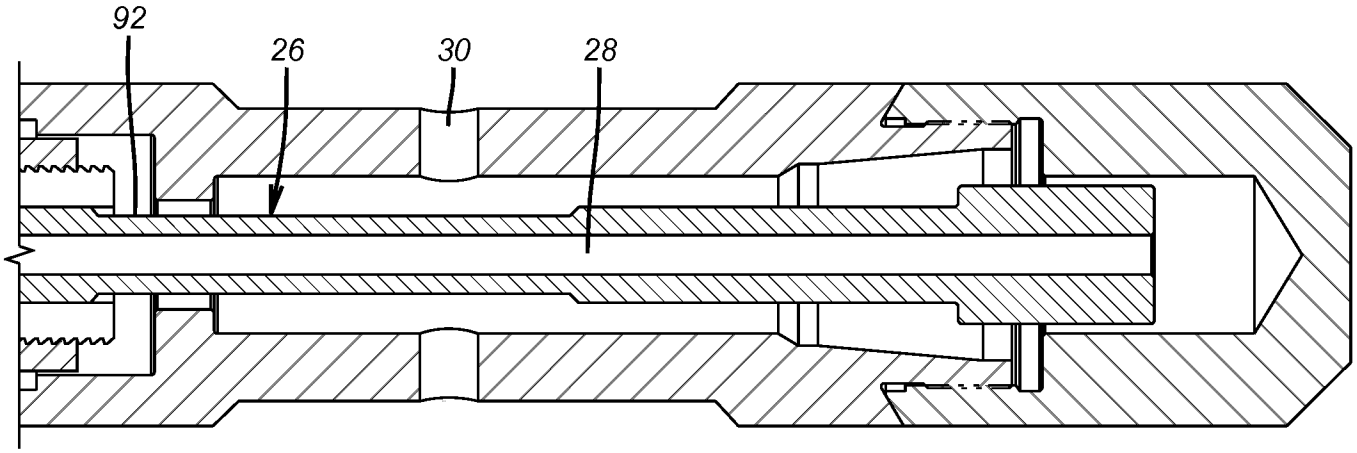
Figure 7:
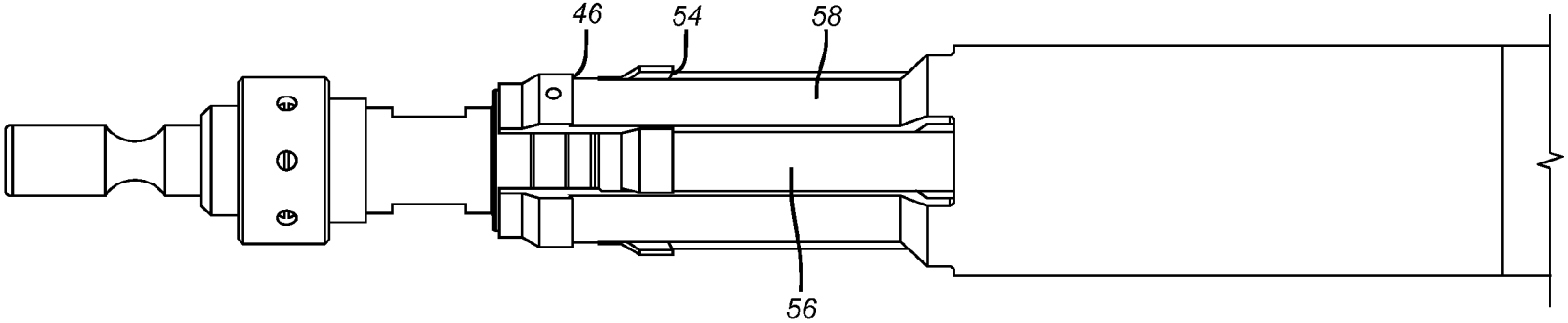
FIG. 7 is an exterior view at the top of the bridge plug showing the alternating finger structure for the equalizing sleeve and the release sleeve.

Packer or plug release sleeve 52 has a similar exterior profile 54 as the previously described profile 46 except the locations for the multiple profiles 54 that appear on ends of a finger structure 56 shown in FIG. 7 are circumferentially offset from the profiles 46 that appear on another set of axial fingers 58 shown in FIG. 7. The release sleeve 52 initially traps collet heads 60 in groove 62 to prevent movement of upper mandrel 64 that is secured to inner mandrel 26 at thread 66. Mandrel body 68 is connected to support collet body 70 at thread 72. Lower collet 74 is connected at thread 76 to the lower end of mandrel body 68. Opposed arrows 78 and 80 represent the location a well-known setting tool applied force for setting the plug 10. A wireline setting tool such as the E-4 sold by Baker Hughes Incorporated of Houston Tex. can be used to set the plug 10. The setting axially compresses the plug 10 to force out the slips 22 and 24 and the sealing assembly 12 in a known manner. An upper ratchet ring 82 will then engage a profile 84 on mandrel body 68 that starts out located further downhole before the setting of the plug 10 as shown in FIG. 1*b*. At the lower end a lower collet 74 has an exterior profile 86 engaged to profile 88 and held engaged by the placement of surface 90 of inner mandrel 26. A recess 92 can be selectively aligned with profiles 86 and 88 to release them from each other when the plug 10 is released. Profile 88 is on lock ring 96. Lower cone 20 has a ratchet profile 94 configured to allow ratchet profile 86 to ratchet over it when profile 86 moves uphole for release but when profiles 86 and 94 are re-engaged there is only force transmission into the lower cone 20 and no ratcheting action. This feature comes into play if the slips 22 and 24 do not release when recess 92 aligns with lower collet 74. In that event the mandrel body 68 is moved down to engage profiles 86 and 94 for tandem movement which has the result of pushing the lower cone 20 down and away from lower slips 24 to effect the release of the plug 10. This new feature goes beyond typical lock ring arrangements that simply are defeated in an attempt to release the packer. At times the potential energy in the packer element is insufficient to extend the sealing element and slip arrangement. Alternatively, on the way out of the hole the slips can re-engage the surrounding tubular as the lower cone works its way back under the lower slips. The arrangement of ratchet profiles allows addressing such events by engaging profiles 86 and 94 for tandem downhole oriented movement to break the slips loose for another attempt to get the plug or packer to come out of the hole.

Figure 2A:
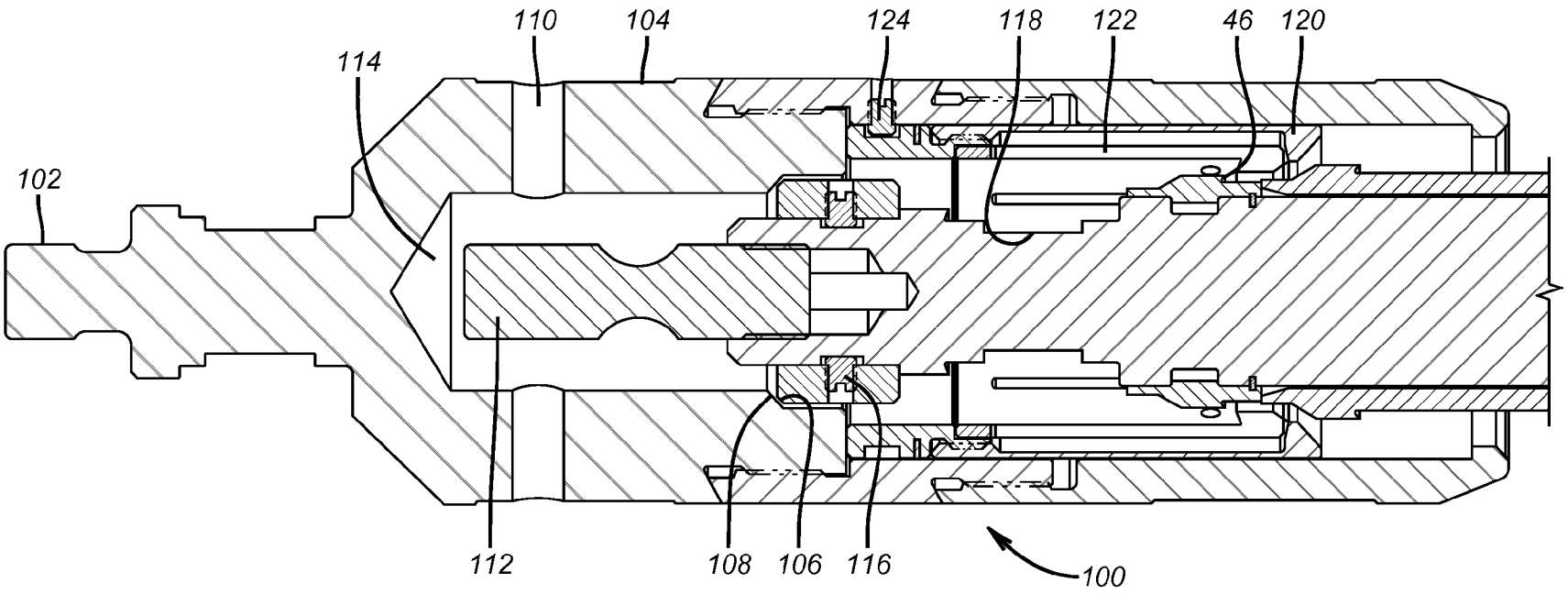
FIGS. 2*a*-2*b* show a section view of the grip tool in the initial configuration where the equalizing sleeve assembly can be gripped.
Figure 2B:
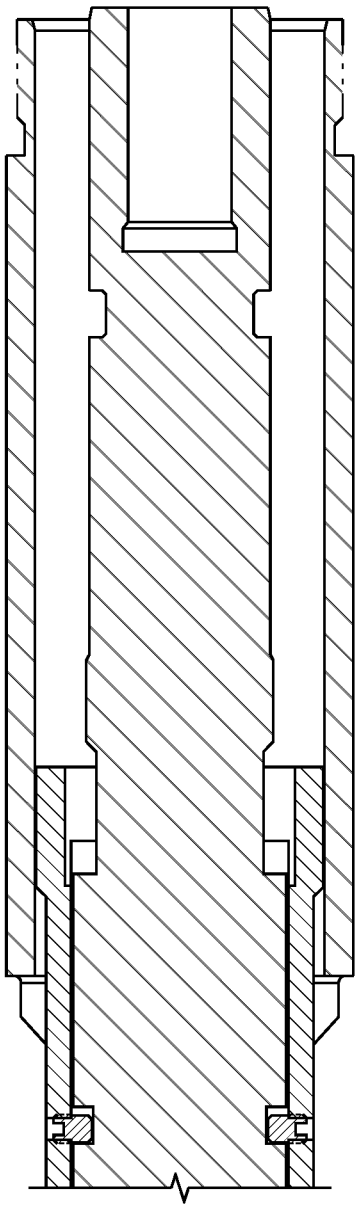
Figure 3A:
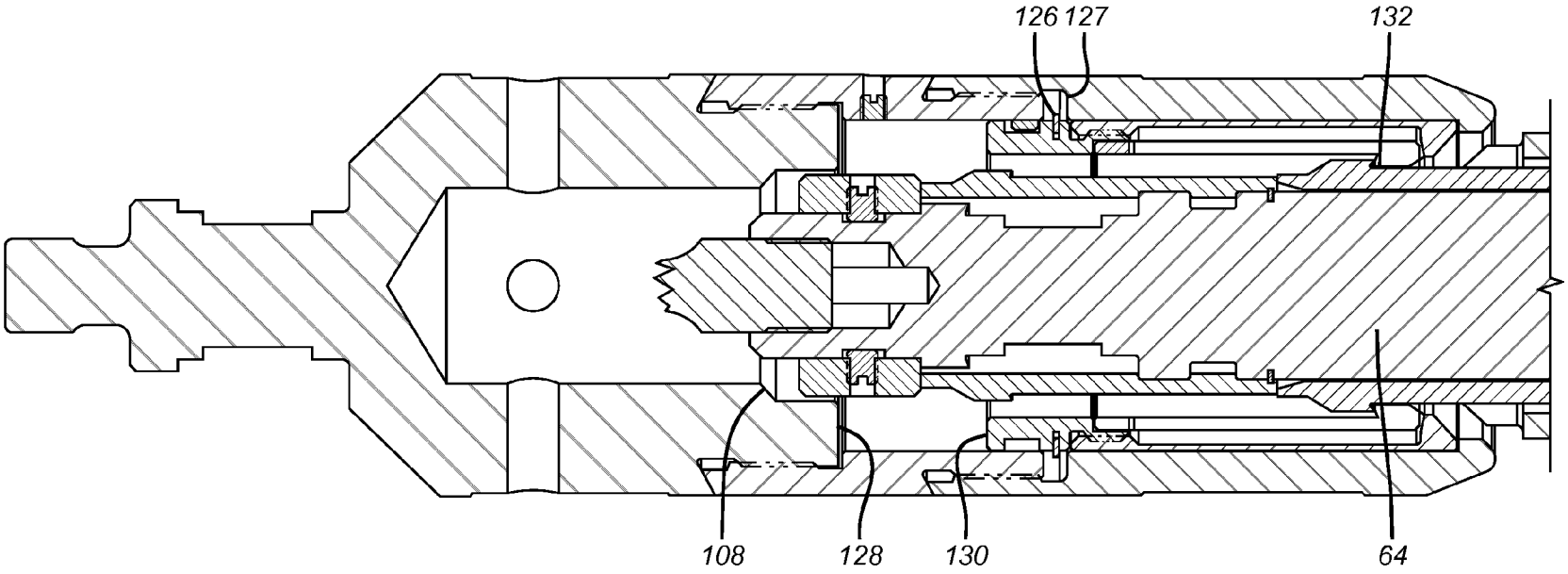
FIGS. 3*a*-3*b* is the view of FIGS. 2*a*-2*b* with the grip tool latched in a second and longer configuration so that it can reach the release sleeve.
Figure 3B:
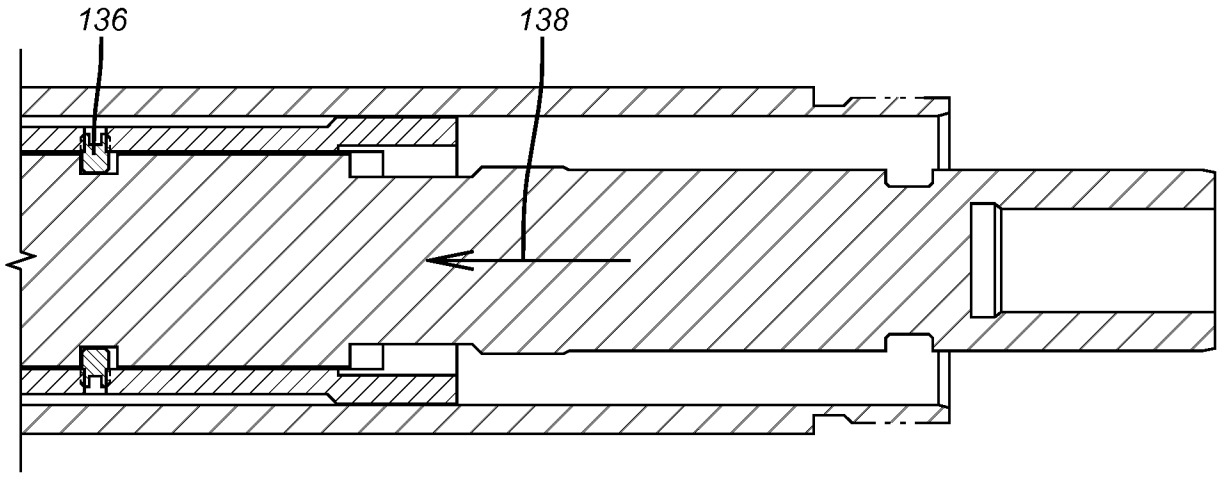
Figure 4A:
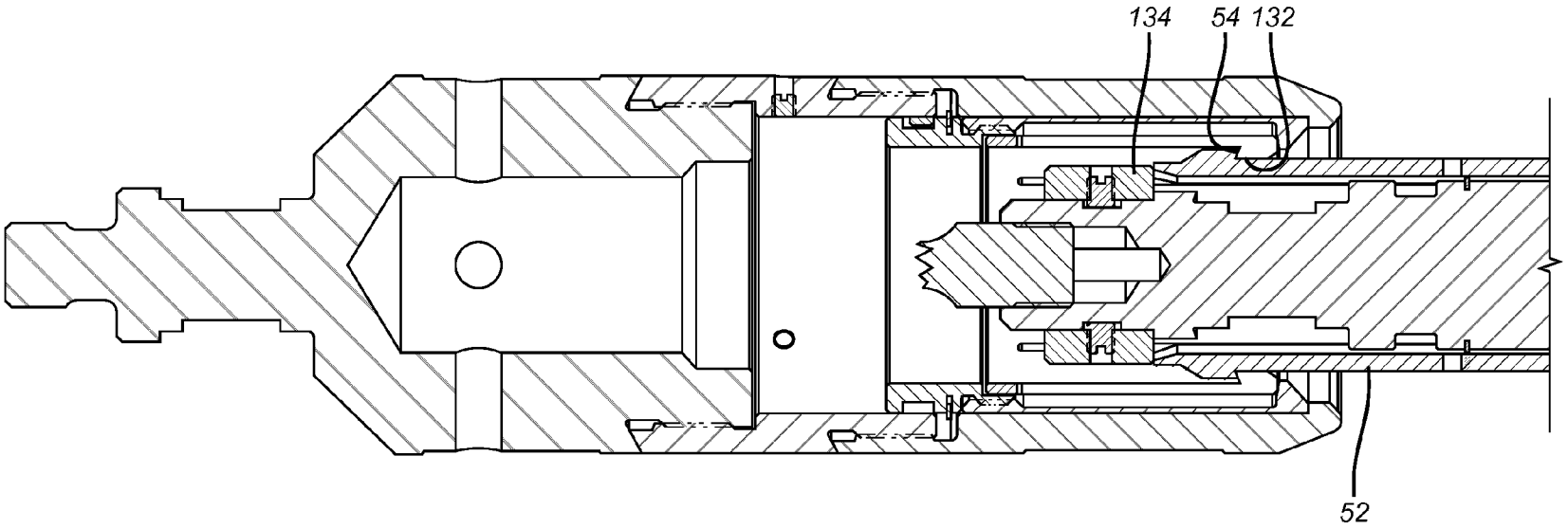
FIGS. 4*a*-4*b* is the view of FIGS. 3*a*-3*b* with the grip tool engages to the release sleeve and ready to release the packer or bridge plug.
Figure 4B:
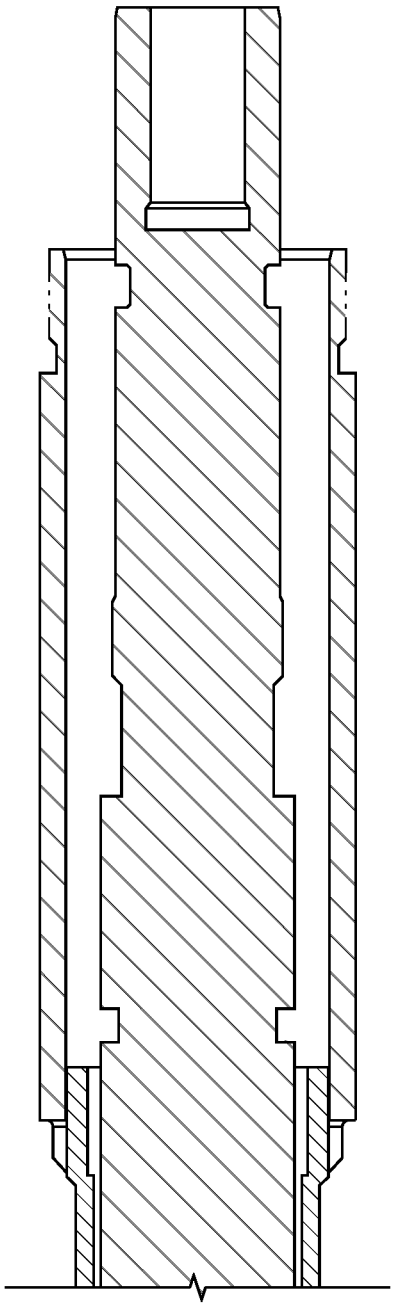
Figure 5A:
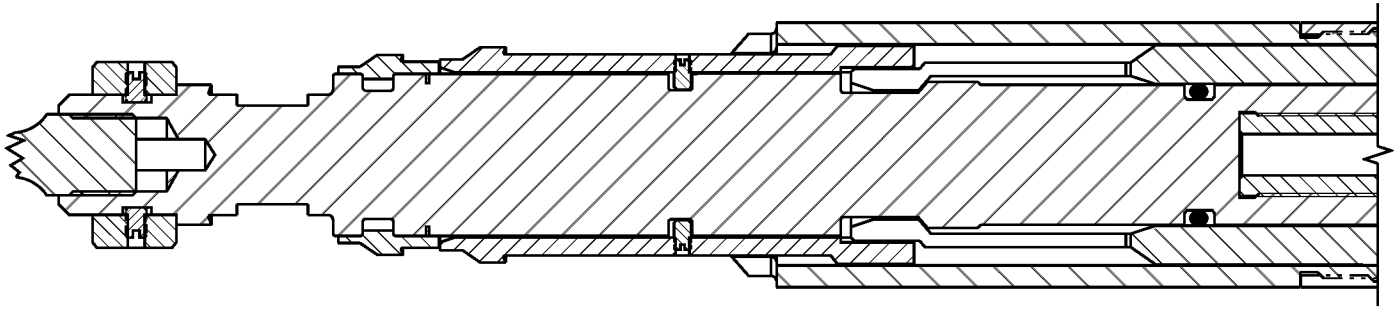
FIGS. 5*a*-5*d* show a section view of the bridge plug in the set position.
Figure 5B:
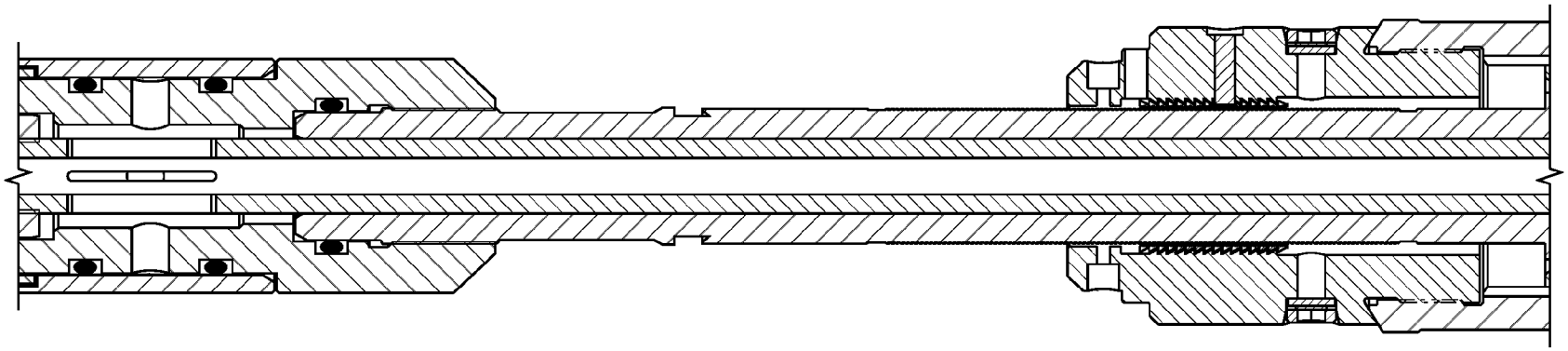
Figure 5C:
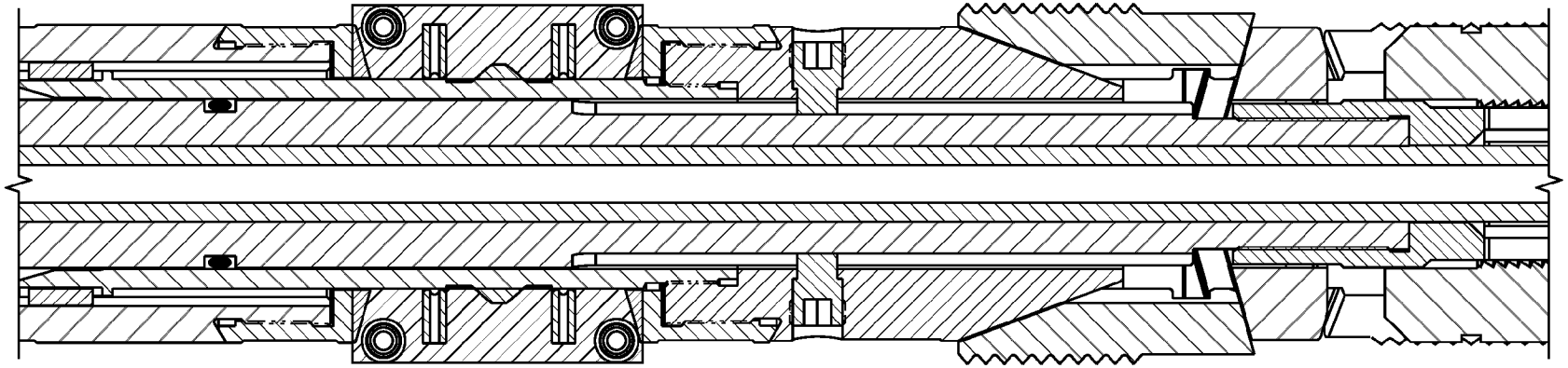
Figure 5D:
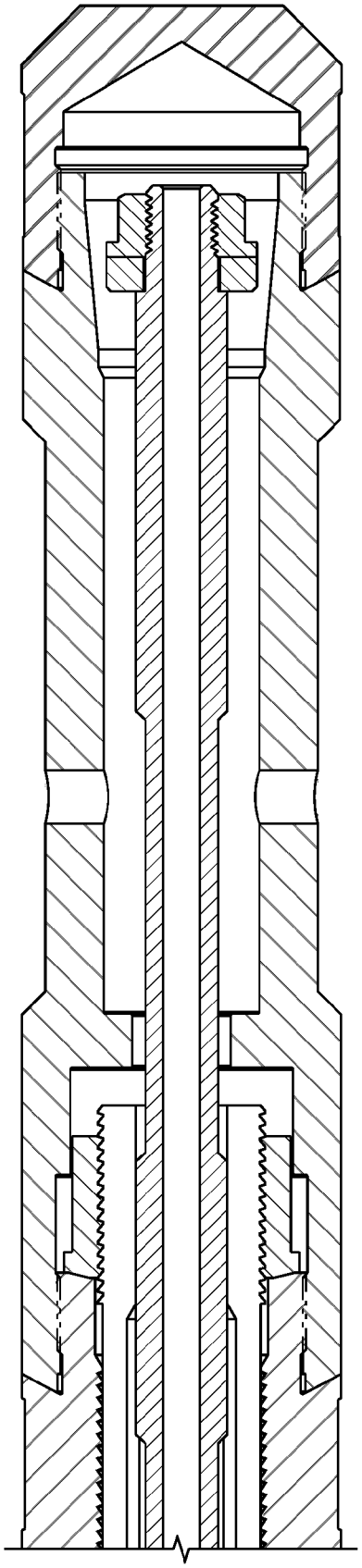

The grip tool 100 is illustrated in FIGS. 2-4. Its purpose is to initially equalize the plug or packer 10 from the set position and then release and retrieve it. It is delivered in a variety of ways as mentioned above but a wireline (not shown) connected at 102 is preferred. Upper housing 104 advances until surfaces 106 and 108 shoulder out as shown in FIG. 2*a*. Vent ports 110 allow fluid displacement from internal chamber 114 going over the shear stud 112 that is shown un-sheared. Normally, the E-4 wireline setting tool mentioned above is secured to the shear stud to apply a force in the direction of arrow 80 as shown in FIG. 1*a* and discussed above. Normally the small diameter part of the shear stud 112 is supposed to be the shear location but sometimes the stud remains whole so that internal chamber 114 is sized to accept the whole shear stud 112 for those situations. Shear pins 116 allow for release of the tool 100 from the plug or packer 10 in the event the packer fails to equalize and release so that the wireline (not shown) and the tool 100 can be removed so that a fishing tool can be attached to profile 118 or alternatively the plug or packer 10 can be milled out.

Figure 6A:
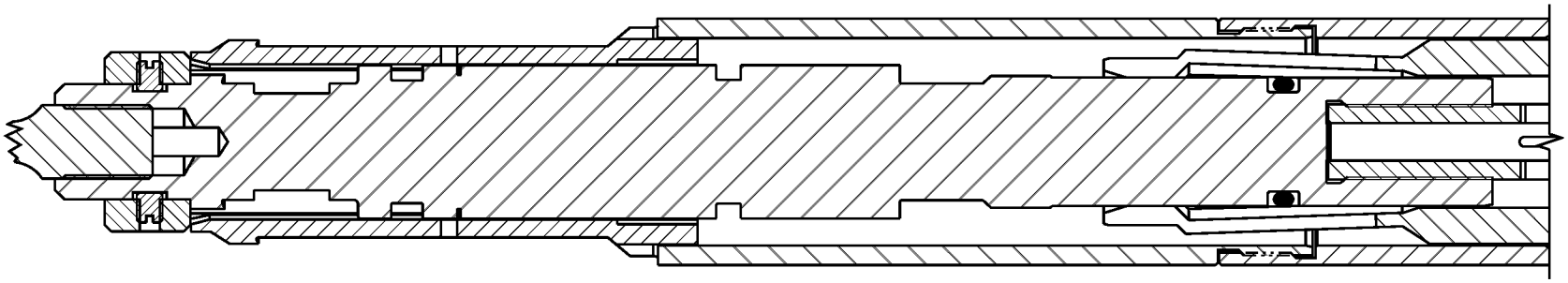
FIGS. 6*a*-6*e* is the view of FIGS. 5*a*-5*d* in the released position and ready for removal from the borehole.
Figure 6B:
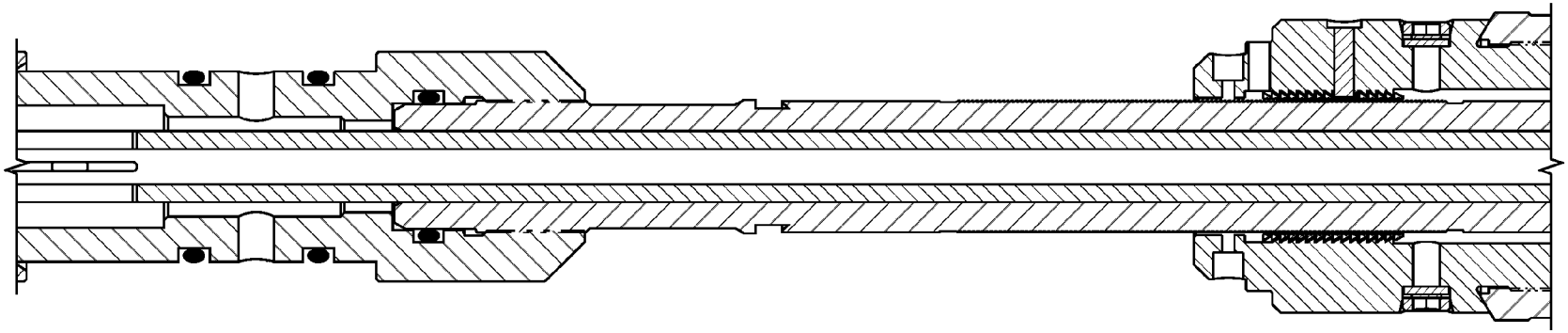

The profile 46 is initially gripped as outer collet support ring 120 and the grip collet ring 122 that is concentrically mounted to support ring 120 are deflected radially outwardly over the profiles 46 that exist at ends of extending fingers 58 as shown in FIG. 7 and snaps back by the time surfaces 106 and 108 shoulder out. This initial movement can be accomplished with a downward jarring to get surfaces 106 and 108 to connect. A subsequent upward jarring with the collet ring 122 supported by ring 120 against the profile 46 results in movement of sleeve 36 away from o-ring 40 to open ports 34 for equalization of pressure through passage 28 as described above. The open position for sleeve 36 is also shown in FIG. 6*a*-6*b* where o-ring 38 has also been uncovered as the plug 10 is being removed.

Figure 6C:
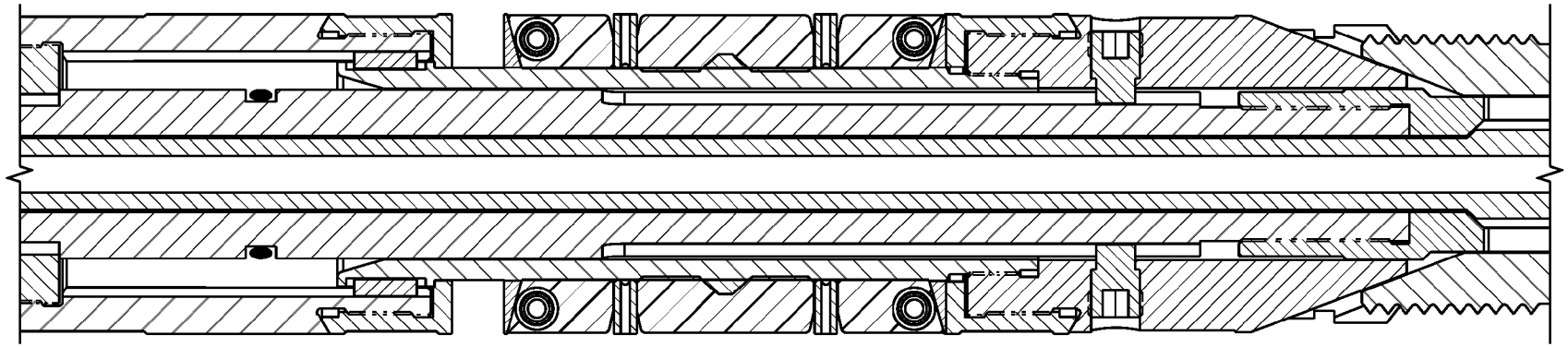
Figure 6D:
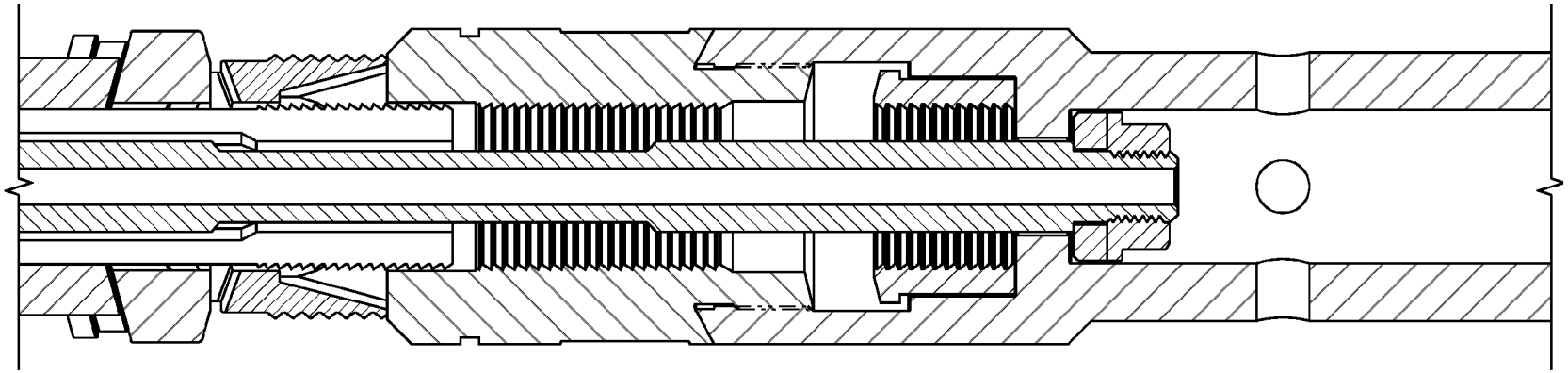
Figure 6E:
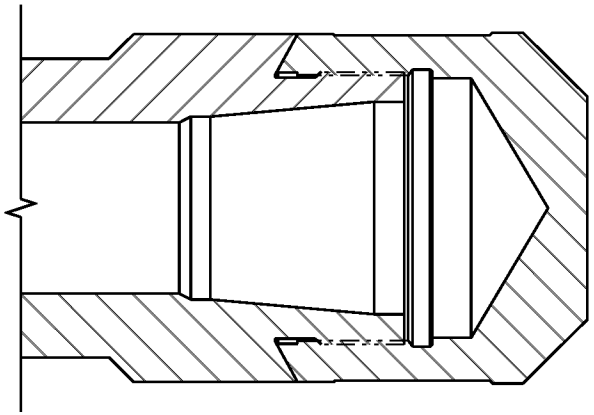

Having equalized pressure across the seal assembly 12 a further upward jar force is applied to tool 100 while still engaged to the profile 46 so that shear pins 124 fail as seen by comparing FIGS. 2 and 3. With pins 124 sheared the upward applied force results in telescopingly extending the tool 100 in an axial direction and locking in the extension with a snap ring 126 extending radially into surrounding groove 127 as shown in FIG. 3*a*. This creates a gap between surfaces 128 and 130 which were previously abutting. It also locks in a greater distance between surface 108 and grip surface 132 such that when surface 108 acts as a travel stop when jarring down again the position of surface 132 will be below profiles 54 that are on fingers 56. As shown in FIG. 4*a*, an upward jar force then applied will pull up profiles 54 for the release of the plug or packer 10. Sleeve 52 is pulled up to the point of engaging ring 134 after shearing screws 136, which is best seen in comparing FIGS. 3 and 4. Movement of sleeve 52 releases collet heads 60 from their respective groove 62 which then allows upper mandrel 64 to move in the direction of arrow 138. With upper mandrel 64 moving, inner mandrel 26 moves up to present recess 92 even up with locked profiles 86 and 88 so that they can then separate under the potential energy in the sealing element 12 to push the lower cone 20 out from under the lower slips 24. A pickup force on the tool 100 should then get surfaces 140 and 142 to shoulder out as shown in FIG. 6*c* so that the tool 100 can remove the plug 10 from the borehole. As explained above, if the plug 10 does not release this way, jarring down on tool 100 brings profiles 86 and 94 back together for tandem movement in a downhole direction to force the lower cone 20 downhole and out from under the lower slips 24.

Those skilled in the art will appreciate that the extendable nature of the tool overcomes a risk of debris preventing the dogs in U.S. Pat. No. 8,322,413 from retracting. Such a failure of the dogs to retract into a recess will prevent plug or packer release as the tool in that patent would be precluded from reaching the release sleeve. By providing an extendable tool that is run in to release the packer or plug the exposure of components to wellbore debris is minimized thereby insuring operability when needed to equalize and release the packer. Instead of the dog design of the past, the telescoping feature of the tool 100 allows for a simple way to integrate the ability to change the reach of the tool to sequentially equalize and then release the plug or packer. The use of the ratchet profiles that lock together for tandem movement in a downhole direction provides a backup way to get the slips and sealing element to release in the event that jarring up on the release sleeve and reliance on the potential energy in the sealing element 12 does not allow the slips and sealing element to extend axially so that they retract radially to allow plug removal.

The above description is illustrative of the preferred embodiment and many modifications may be made by those skilled in the art without departing from the invention whose scope is to be determined from the literal and equivalent scope of the claims below:

We claim:

1. A dual release method for packer or bridge plug, comprising:

unlocking first and second ratcheting profiles that hold the set of a sealing element and at least a lower slip with axial mandrel movement that allows said first and second ratcheting profiles to separate, so that after said separation stored energy in said sealing element is released to push a lower slip cone away from a lower slip to allow said lower slip to axially extend and radially retract for a normal release: and a lower slip cone third ratcheting profile oriented to allow said first ratcheting profile to ratchet past said third ratcheting profile after the packer or bridge plug is released with separation of said first and second ratcheting profiles;

repositioning said first ratcheting profile, after ratcheting over said third ratcheting profile back into contact with said third ratcheting profile on said lower slip cone for tandem movement of said mandrel and said lower slip cone away from said lower slip to release the packer or bridge plug in the event said normal release fails.

2. The method of claim 1, comprising:

allowing said mandrel to move relatively to said second ratcheting profile.

3. The method of claim 2, comprising:

placing said first ratcheting profile associated with said mandrel on at least one collet.

4. The method of claim 3, comprising:

selectively supporting said first and second ratcheting profiles against each other with said mandrel.

5. The method of claim 4, comprising:

selectively allowing said first and second ratcheting profiles to separate with axial movement of said mandrel.

6. The method of claim 5, comprising:

positioning a recess on said mandrel adjacent said first and second ratcheting profiles to allow them to radially separate.

7. The method of claim 6, comprising:

allowing said sealing element and slips to radially retract from axially extending as a result of said positioning said recess adjacent said first and second ratcheting profiles.

8. The method of claim 3, comprising:

engaging said collet with said mandrel for tandem axial movement that axially separates said first and second ratcheting profiles from each other subsequent to radial separation of said first and second ratcheting profiles enabled by axial mandrel movement.

9. The method of claim 8, comprising:

positioning a recess on said mandrel adjacent said first and second ratcheting profiles to allow them to radially separate.

10. The method of claim 1, comprising:

forcibly pushing said lower slip cone away from said lower slip by applying a force on said third ratcheting profile.

11. The method of claim 1, comprising:

delivering a telescoping grip tool in a first configuration to engage the packer or bridge plug at a first location;

equalizing pressure across the set packer with movement of said telescoping grip tool;

placing said grip tool in a second configuration after said equalizing;

engaging a second location on said packer or bridge plug with said grip tool in said second configuration;

releasing said packer or bridge plug after with movement of said grip tool in said second configuration.

12. The method of claim 11, comprising:

undermining said first and second ratcheting profiles that held the set of said packer or bridge plug with a force delivered by said grip tool when engaged to said second position on said packer or bridge plug;

allowing a sealing element and lower slip on said packer or bridge plug to extend axially and radially retract as a result of said undermining of said first and second ratcheting profiles.

13. The method of claim 12, comprising:

providing a release profile on a lower slip cone;

positioning, with movement of a mandrel by said grip tool, said first ratcheting profile in contact with said third ratcheting profile on said lower slip cone for tandem movement in a direction taking said lower slip cone in a direction away from said lower slip as a backup release for said packer or bridge plug.

* * * * *